US008181819B2

(12) United States Patent
Burney et al.

(10) Patent No.: US 8,181,819 B2
(45) Date of Patent: May 22, 2012

(54) LID AND CONTAINER

(75) Inventors: Forrest A. Burney, Raleigh, NC (US); Charles Watling, Raleigh, NC (US)

(73) Assignee: BWAY Corporation, Raleigh, NC (US)

( * ) Notice: Subject to any disclaimer, the term of this patent is extended or adjusted under 35 U.S.C. 154(b) by 1063 days.

(21) Appl. No.: 12/042,816

(22) Filed: Mar. 5, 2008

(65) Prior Publication Data

US 2008/0230550 A1 Sep. 25, 2008

Related U.S. Application Data

(63) Continuation-in-part of application No. 11/539,892, filed on Oct. 10, 2006, now Pat. No. 7,963,419.

(60) Provisional application No. 60/776,176, filed on Feb. 23, 2006, provisional application No. 60/989,569, filed on Nov. 21, 2007.

(51) Int. Cl.
*B65D 39/00* (2006.01)
*B65D 41/16* (2006.01)
*B65D 41/18* (2006.01)

(52) U.S. Cl. ..... 220/792; 215/344; 220/780

(58) Field of Classification Search ..... 220/780, 220/784, 789, 790, 792, 794, 795; 215/344
See application file for complete search history.

(56) References Cited

U.S. PATENT DOCUMENTS

| | | | |
|---|---|---|---|
| 3,463,340 | A | 8/1969 | Lindstrom |
| 3,642,167 | A | 2/1972 | Kinney |
| 3,817,420 | A | 6/1974 | Heisler |
| 4,210,258 | A | 7/1980 | Von Holdt |
| 4,256,240 | A | 3/1981 | Woinarski |
| 4,293,080 | A | 10/1981 | Letica |
| 4,296,871 | A | 10/1981 | Andersson |
| 4,305,517 | A | 12/1981 | Dennis |
| 4,356,930 | A | 11/1982 | Roper |
| 4,442,947 | A | 4/1984 | Banich, Sr. |
| 4,453,646 | A | 6/1984 | Harrild |
| 4,457,447 | A | 7/1984 | Kirkis |
| 4,518,097 | A | 5/1985 | Milton et al. |
| 4,524,882 | A | 6/1985 | Buc |
| 4,560,077 | A | 12/1985 | Dutt |
| 4,566,601 | A | 1/1986 | Kuenzig |

(Continued)

FOREIGN PATENT DOCUMENTS

| | | |
|---|---|---|
| CA | 2060982 | 11/2004 |

OTHER PUBLICATIONS

Feb. 2, 2010 letter from Kristina Castellano with enclosure.

*Primary Examiner* — Harry Grosso

(74) *Attorney, Agent, or Firm* — Schnader Harrison Segal & Lewis LLP

(57) ABSTRACT

A lid for a container is disclosed that has a series of seals. The first seal is a cork seal mechanism that is forced against the container interior at a top portion of the container. The second seal is created by at least two ribs that produce a spring-like force against the container. An additional stretch fit seal can be incorporated into the lid. A tear strip can also be incorporated into the lid with windows immediately above the tear strip, thereby forming slits in the skirt to aid in removal of the lid.

24 Claims, 12 Drawing Sheets

U.S. PATENT DOCUMENTS

| | | | | |
|---|---|---|---|---|
| 4,577,776 | A | | 3/1986 | Rayner et al. |
| 4,632,265 | A | | 12/1986 | Cochrane |
| 4,658,977 | A | | 4/1987 | Crisci |
| 4,660,735 | A | | 4/1987 | Peschardt et al. |
| 4,667,843 | A | | 5/1987 | Galer |
| 4,815,620 | A | | 3/1989 | Bullock, III |
| 4,836,407 | A | | 6/1989 | Bruce et al. |
| 4,887,735 | A | | 12/1989 | Dudzik |
| 4,930,656 | A | | 6/1990 | Blanchette |
| 4,961,512 | A | | 10/1990 | Von Holdt |
| 4,984,701 | A | | 1/1991 | Margaria |
| 5,046,632 | A | | 9/1991 | Bordner |
| 5,097,977 | A | | 3/1992 | Straub |
| 5,125,530 | A | | 6/1992 | Straub |
| 5,328,047 | A | | 7/1994 | Smith |
| 5,460,287 | A | | 10/1995 | Cargile et al. |
| 5,536,161 | A | | 7/1996 | Smith |
| 5,730,309 | A | * | 3/1998 | Jiradejnunt et al. ..... 220/276 |
| 5,873,484 | A | | 2/1999 | Clute et al. |
| 6,279,774 | B1 | | 8/2001 | Clute et al. |
| 6,325,226 | B1 | | 12/2001 | Krautkramer |
| 6,435,384 | B1 | | 8/2002 | Davis et al. |
| 6,845,877 | B2 | | 1/2005 | Diesterbeck |
| 7,055,708 | B1 | | 6/2006 | Haffner et al. |
| 7,207,457 | B2 | * | 4/2007 | Schwarz ..... 220/276 |
| 2007/0272649 | A1 | | 11/2007 | Dreyer et al. |

* cited by examiner

LID AND CONTAINER

This application is based on, and claims priority to, U.S. provisional application Ser. No. 60/776,176, having a filing date of Feb. 23, 2006, entitled Gasketless Container and Lid; U.S. provisional application Ser. No. 60/989,569, having a filing date of Nov. 21, 2007, entitled Lid and Container; and U.S. patent application Ser. No. 11/539,892, having a filing date of Oct. 10, 2006, entitled Lid and Container.

FIELD OF THE INVENTION

The invention is related to containers and the associated lids, wherein the lids provide a seal that reduces or eliminates the need for a gasket.

BACKGROUND OF THE INVENTION

The invention, as outlined in the following narrative, is a variation of a molded plastic industrial container of a type in common usage today for the containment and shipping of various substances including, but not limited to, foods and foodstuffs, paints, oils, solvents, and other industrial chemicals. Generally, the container and lid are injection molded from a commodity plastic compound such as high density polyethylene or polypropylene and typically utilize a gasket of compressible foam or rubber between the contact surfaces of the pail and cover to form a liquid tight seal. Containers of this type typically fall within the capacity ranges of 1 gallon up to 10 gallons.

FIG. 1 depicts a prior art pail and lid. The general container configuration in common usage today is comprised of a wide mouth pail commonly referred to as an "openhead" pail, and a lid which affixes over the pail opening. Installation of the lid 1 is accomplished by applying axial pressure to the top of the lid, forcing its mechanical latching features to expand radially over corresponding latching features on the pail until it locates axially into its final position and the latching features relax into corresponding undercuts in the pail exterior. It is noted that the term "pail" is used broadly herein and does not necessarily require that the item has a handle.

The lid 1 exterior is generally comprised of a recessed center panel 6, a raised channel 7 designed to straddle the top of the pail sidewall, and an outer skirt 24 having a tear strip 8 that extends downward below the level of the panel 6. The pail exterior is generally a tapered cylinder typically having a series of satellite rings 3, 4, 5 around its upper half that may provide additional stiffness to the pail opening and protect the container in the event of a side-oriented drop. These satellite rings may be simple single ribs of plastic extending radially from the pail wall 3, 4 or they may be more geometrically complex rings 5 honeycombed with internal rib structures to provide even more stiffness. Additionally, the pail opening is topped by a thicker, rounded ring or lip 9. In a gasketed container, this pail lip provides both the pail component of the main pail-to-cover latching mechanism and the sealing surface that interfaces with the compressible foam gasket.

SUMMARY OF THE INVENTION

Embodiments of the disclosed invention include a lid for a container that reduces or eliminates the need for a gasket by providing a series of seals. The first seal is a cork seal mechanism that is forced against the container interior at a top portion of the container. The second seal is created by at least two ribs that create a spring-like force against the pail, preferably at the pail lip. As used herein "lip" refers to any top edge of a container. Such edges may be for example, greater in thickness than the container wall, of equal thickness or of a rolled configuration. An additional seal may be incorporated that includes a skirt having a tear strip. The skirt has a first hook above the tear strip that will engage the pail lip or a rib on the pail after the tear strip is removed. A second hook is position on the tear strip and engages a rib on the pail below the lip or rib to which the first hook engages. This hook is engaged when the tear strip is in place.

In a further illustrative embodiment of the invention, the lid contains a substantially u-shaped circumferential protrusion extending downward from the lid top portion with the opening of the "u" facing downward. This u-shaped protrusion serves as a cork seal mechanism. The first and second ribs are between the u-shaped cork seal mechanism and the lid side portion. This u-shaped protrusion may also provide additional support to a container/lid combination on which it is used. A latching mechanism, such as a bead may extend from the u-shaped protrusion to engage the inner surface of a container wall.

In yet a further embodiment of the invention, the ribs of the second seal are of different flexibility or stiffness. When the lid is positioned on the container, one or more flexible ribs are forced against one or more rigid ribs.

These and additional aspects of the invention will be discussed in more detail below.

DESCRIPTION OF THE DRAWINGS

The invention is best understood from the following detailed description when read with the accompanying drawings.

DETAILED DESCRIPTION OF THE INVENTION

Figure 1:
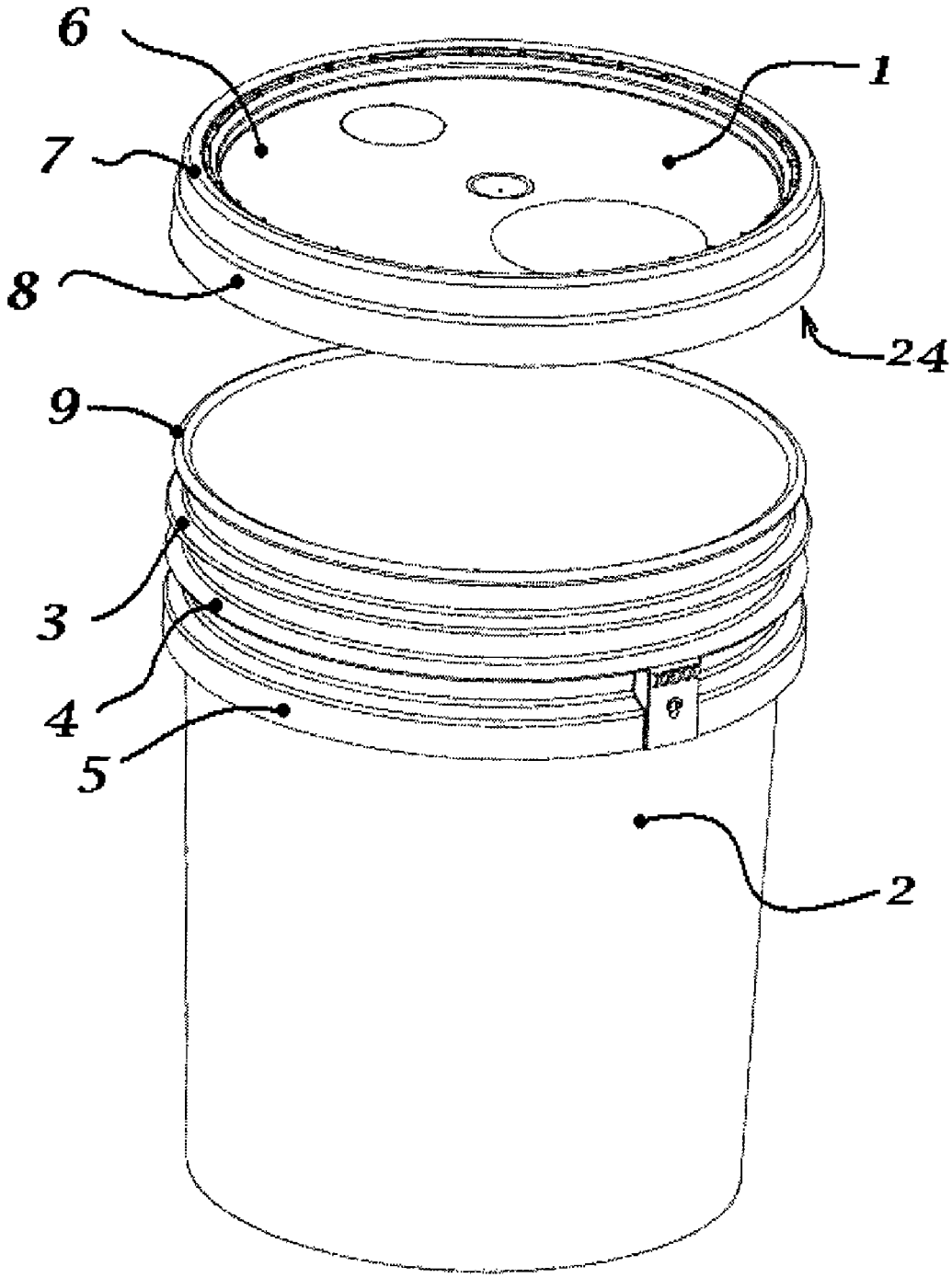
FIG. 1 depicts a prior art pail and lid.
Figure 2:
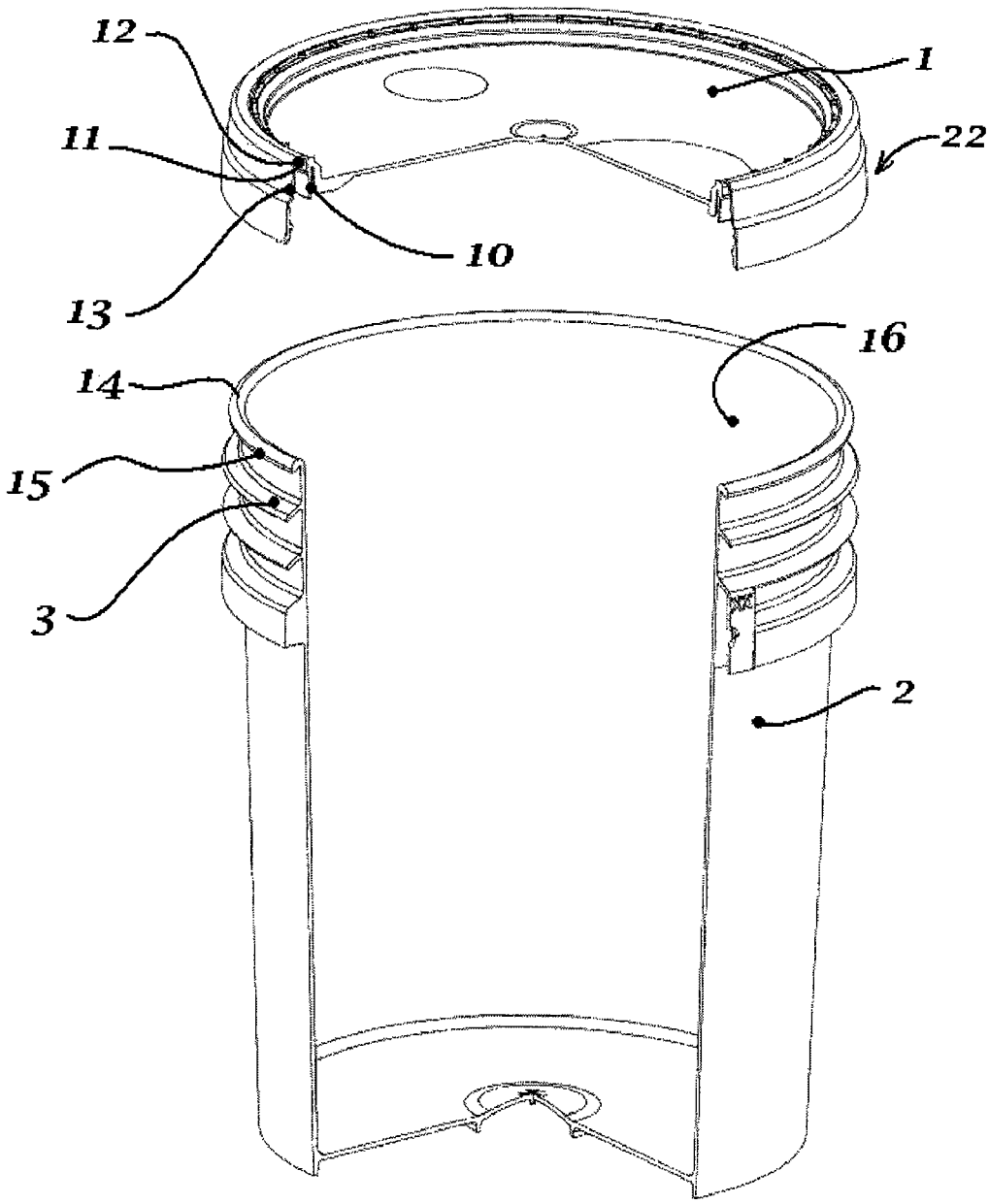
FIG. 2 depicts a cutaway of a lid according to an illustrative embodiment of the invention.

An illustrative embodiment of the inventive pail and lid is shown in FIGS. 2-5 as a wide mouth pail. This illustrative embodiment incorporates features of the prior art pail shown in FIG. 1. The exemplary embodiment of FIGS. 2-5 eliminates or reduces the need for a compressible gasket, utilizing instead distinct plastic-to-plastic sealing mechanisms in combination with a unique latching arrangement to effect a liquid-tight seal. First, a circumferential plastic rib 10 extends downward from the underside of the lid 1. The outer diameter of this rib is tapered and stepped such that, during lid installation, it initially clears the inner pail side wall 16. As the lid is pressed into its final position, the outer diameter of the rib 10 transitions to a larger diameter surface 18 that forms an interference fit with the inner pail wall 16, creating a plug seal similar to that of a cork in the neck of a bottle. Second, two thin, tapered circumferential ribs 11, 12 extend downward, preferably at outwardly sloping angles from the underside of the lid's channel 7, the outermost of these ribs 12 being somewhat shorter than the innermost rib 11. When the lid is pressed into the latched position on the pail, the innermost rib contacts the top surface 14 of the pail lip 9 and is deflected upward and outward, placing the rib material in tension and forming a compressive plastic-to-plastic seal with the top surface 14 of the pail lip 9. Near the end of its deflection, the longer innermost rib 11 contacts the shorter outermost rib 12, deflecting it also in an outwardly direction. The resulting reciprocal force applied by these ribs in combination against the top surface 14 of the pail lip 9 assures continuous plastic-to-plastic contact, forming a liquid tight secondary seal. Lastly, the inner surface 13 of the outermost wall of the lid is sized such that it is of a diameter smaller than that of the outer surface of the pail lip 15. As the lid 1 is pressed into its final position, this outer lid wall 13 stretches over the outer lip surface 15 of the pail, effecting a tertiary liquid tight seal. The integrity of these three unique sealing mechanisms in combination has been proven liquid-tight under multiple test conditions.

The method of latching this lid to the container is also somewhat unique, and driven, in part, by the requirements of the sealing mechanisms as listed above. In a typical plastic openhead pail and lid assembly, as commercially available today, the primary latching mechanism is a large hook, or undercut, molded as part of the inner wall of the cover's outermost diameter, which deforms during lid application until it passes the pail lip, at which point it relaxes back into shape below the pail lip, securing the lid to the pail. Typically these lids are segmented to facilitate removal, as each segment must be pried away from the pail in series in order to release the hook and remove the lid.

To effect the interference seal between the inner cover surface 13 and outer pail lip surface 15, it is necessary for the cover's outer wall to form a continuous and unbroken surface. This precludes the segmentation of this wall to facilitate cover removal by the end user as is done in a typical openhead pail lid. The gasketless container, therefore, relies on non-traditional latching techniques.

Embodiments of the gasketless container utilize two latches, primary and secondary mechanisms, to affix the lid to the pail and a removable circumferential tear strip 8 to facilitate the initial opening of the container. Tear strip 8 is removable from lid 1 at a point between hooks 19 and 20. The primary latch mechanism, used for the initial lid application by the filler, consists of a circumferential hook feature 19 located far down the inside of the outer wall of the lid which interfaces with the topmost satellite ring 3 of the pail.

As the lid is applied to the pail, the cover hook 19 is forced to expand over the pail's ring 3 until it snaps past said ring and locks into place below it, securing the lid to the pail. The secondary latch, useful only for resealing of the container after the initial opening, consists of a much smaller hook 20 located farther up on the inside of the outer lid wall which, in application, deforms around and snaps under the pail lip 9.

This highlights one of the key differences between the gasketless pail and traditional pails. Where traditional containers may have satellite rings to add stiffness and improve drop performance, the uppermost ring on the gasketless pail is used as a latching feature and its location relative to the corresponding latching feature on the lid is important to performance of the seal mechanisms.

In use, the pail and lid function as follows:

The open pail 2 is filled with its contents.

The lid 1 is placed upon the pail 2 and pressure is applied to force it into its final position. At this point, both the primary 19 and secondary 20 latches have snapped into position and all sealing mechanisms are effectively compressed.

The container is shipped to its retail or wholesale outlet where it is purchased by the end user.

The end user opens the container by gripping the tear tab 17 and removing the bottom skirt section 8 from the lid, effectively removing the primary latching mechanism.

The lid may now be removed by gently prying the remainder of the lid from the pail.

The lid may now be reapplied to the pail by means of hand pressure and the secondary hook becomes the primary latching feature.

The invention will now be described more generally including various embodiments. Lid 1 commonly has a top portion, such as center panel 6, and a side portion 22 extending downward with respect to the top portion along the perimeter of the top portion or from the top edge portion. The term "downward" as used herein does not necessarily indicate a direction perpendicular from the lid top portion, but instead is used in a more general manner to indicate toward ground level when the container is in an upright position. As used herein "top edge portion" refers to an area at or near the perimeter of the lid. The top portion of the lid is disposed over the opening of the container and may extend further outward. The side portion extends from the top portion downward along a portion of the sidewall of the container. The top portion may include a channel, such as the u-shaped latching channel 7 shown in FIGS. 2-4. The u-shaped latching channel may have a curved upper portion as shown in the figures, or have a flat top with channel walls substantially perpendicular thereto. Various channel profiles are included in the scope of the invention, provided they are suitable to accommodate the features of the invention.

The lid provides its superior sealing qualities by incorporating a number of features, including protrusions extending from the underside of the lid's top portion. A cork seal circumferential flap, such as part 10 in FIG. 3, protrudes from the underside of the top lid portion such that when the lid is placed on a container the cork seal flap is forced against an interior wall of the container.

Figure 3:
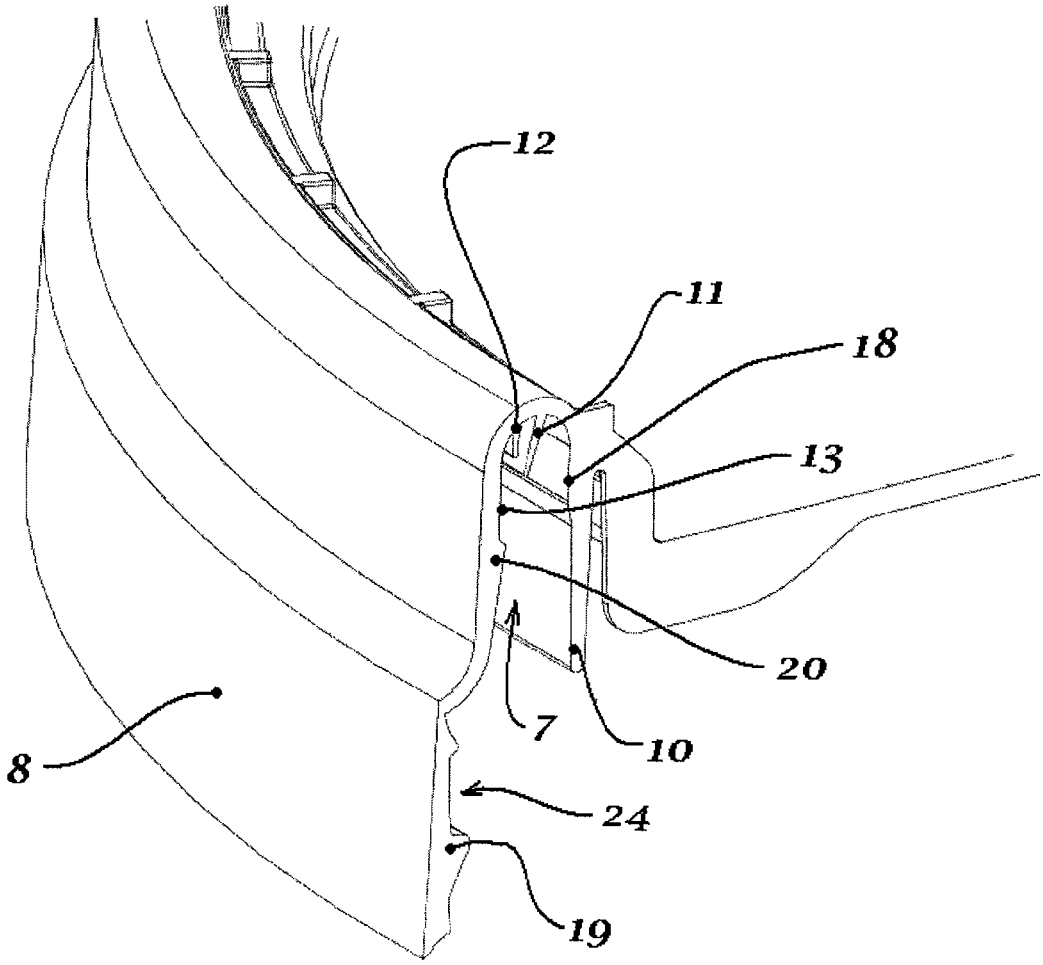
FIG. 3 depicts a cross section of a lid a according to an illustrative embodiment of the invention.
Figure 4:
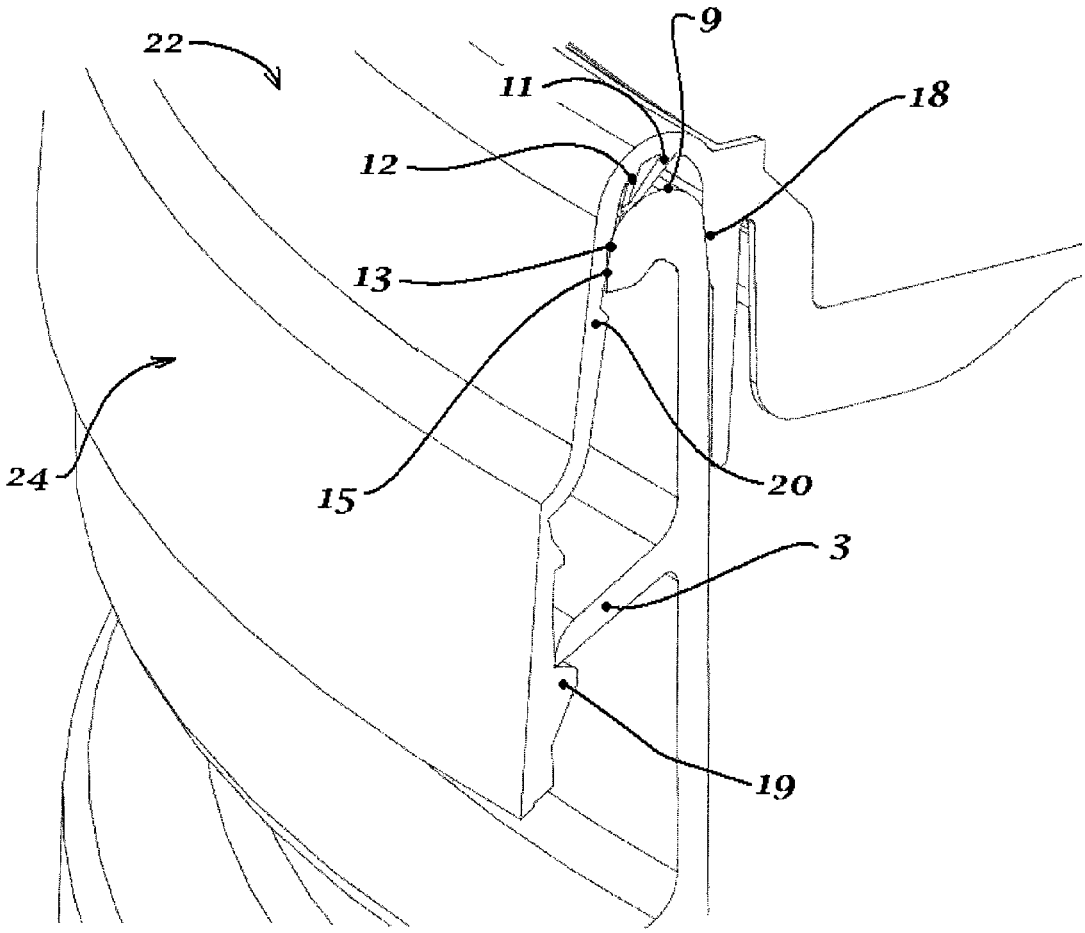
FIG. 4 depicts a cross section of a lid in position on a pail a according to an illustrative embodiment of the invention.

A first circumferential rib, such as component 11, and a second circumferential rib, such as component 12, each extend from the underside of the top lid portion such that when the lid is placed on the container the first rib is deflected toward and contacts the second rib and the second rib is deflected toward and contacts the container. FIGS. 3 and 4 depict ribs 11 and 12 deflecting outwardly. It is noted, however, that this secondary seal can also be accomplished by one or both of the first and second ribs deflecting inwardly or one deflecting inwardly and the other outwardly, provided there is a spring-like force exerted on at least one rib against the container. FIG. 4 depicts the second rib as shorter than the first rib. Depending on the various parameters, such as position of the ribs, deflection direction and lid materials, the first rib may be shorter than the second rib or they may be the same size. Different thicknesses and profiles may also be used to achieve the desired spring-like force that facilitates the sealing property. Additional ribs can be incorporated into the structure to provide extra force for the multi-rib seal or to provide further seals.

An additional seal may be provided by incorporating a skirt with hooks, such as component 24, wherein the skirt has a tear strip, such as component 8. The skirt or lid side portion has two hook closures, such as hooks 19 and 20 (see FIG. 4), extending from the inner surface of the skirt. The hooks latch onto protrusions on the container, such as satellite rings 3, 4 and 5, and lip 9. FIG. 4 depicts a larger hook 19 that engages pail ring 3, and a smaller hook 20 that engages lip 9 after the tear strip is removed. The design shown in FIG. 4 is applicable to the most common pail types on the market that have one or more rings already incorporated into the pail design for stability.

Accordingly, this embodiment of the invention utilizes the existing structural rings. Rings can be incorporated into the pail design specifically to engage the hook, thereby providing additional options. For example, the hooks need not be single fully circumferential hooks, but may be comprised of a group of protrusions at the same height around the pail that can each engage the rib on the pail. It is also possible for the pail rib not to be a single fully circumferential rib. Generally, for manufacturing reasons and ease of lid placement, circumferential ribs and hooks are preferred.

Figure 6:
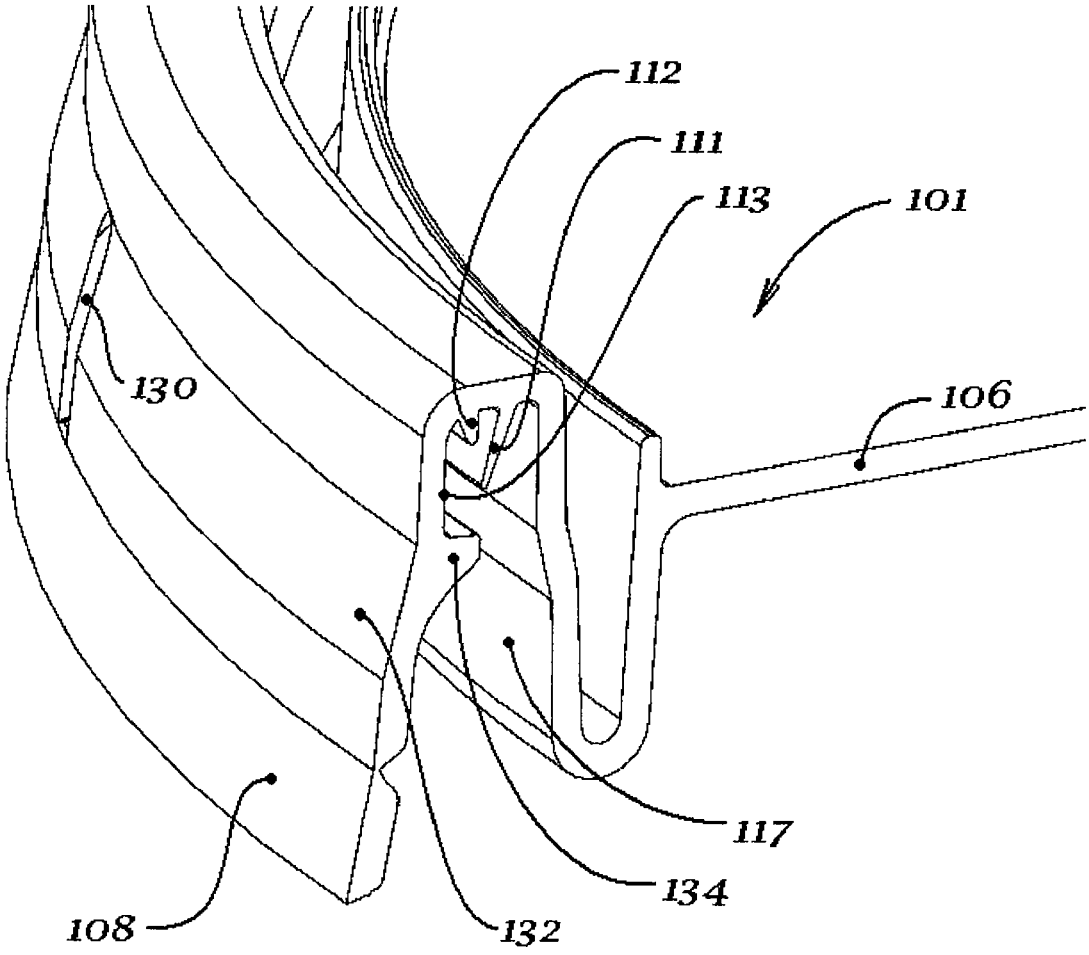
FIG. 6 depicts a cross-section of a lid according to another illustrative embodiment of the invention.
Figure 7:
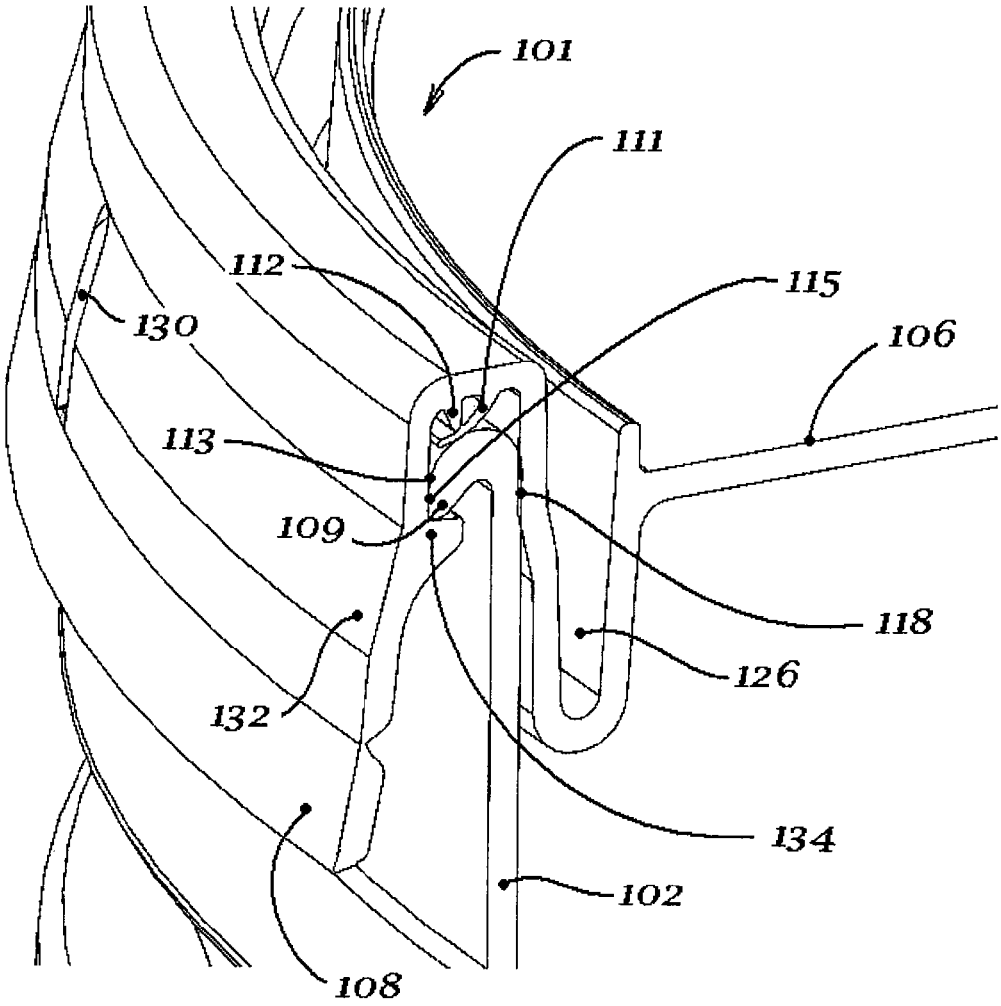
FIG. 7 depicts a cross-section of the lid of FIG. 6, secured on a container according to an illustrative embodiment of the invention.

FIG. 6 depicts a cross-section of a lid according to a further illustrative embodiment of the invention. Cross-sectional FIG. 7 shows the lid of FIG. 6 positioned on a container according to an illustrative embodiment of the invention. In this embodiment, rib 111 is significantly flexible compared to rib 112. Rib 111's flexibility creates a spring-like action against the more rigid rib 112. The stiff second rib 112 limits the flexure of rib 111 to inhibit permanent deformation of rib 111. When the lid is placed on the container or containers are stacked, for example, considerable stress can be exerted on the ribs. If the ribs are allowed to flex too much, they may permanently deform, which will negatively affect the integrity of the seal. For most applications, a single flexible rib and a single stiff rib that remains substantially non-deflected when the lid is secured on the container, will provide adequate protection against permanent deformation of the engaged sealing rib 111. However, it is within the scope of the invention to have more than one of each type of rib. It is also possible to have a series of ribs with varying flexibility. The choice of number, dimensions, location, and flexibility of ribs will depend on one or more of such factors as the inherent stiffness of the materials used, lid/container application, and the size and shape of the lid and container.

FIGS. 6 and 7 also depict an illustrative embodiment of a u-shaped support member 126 incorporated into the lid. U-shaped support member 126 provides additional support to a container/lid combination on which it is used. It also provides a spring-like force against the interior side wall of container 102 at position 118 to serve as a cork seal. The u-shape may provide additional force against the container as compared to that of rib 10 shown in FIG. 3. In the illustrative embodiment of FIGS. 6 and 7, u-shaped support member 126 extends downward from an outer edge of the lid top panel 106. The embodiment depicted in FIGS. 6 and 7 also shows a portion of u-shaped member 126 extending upward from the outer edge of lid top panel 106. This extension is not necessary, but may add to the structural reliability of the lid. In this embodiment, the top surface of the lid extends roughly perpendicular from or near the top of a first leg of u-shaped support member 126, and a latching mechanism extends from the second leg of u-shaped support member 126. U-shaped member 126 can help cushion side impacts and improve drop performance. The particular dimensions and material of u-shaped support member 126 will, at least in part, determine the extent of support and improved performance achieved.

FIGS. 6 and 7 show a tear strip 108. A portion of lid 101 immediately above tear strip 108 contains one or more windows 130 that extend to tear strip 108. When tear strip 108 is removed, windows 130 form slits in the remaining lid skirt 132. The lid can then be plied off the container, for example by inserting a screwdriver beneath skirt 132. Other tear strip configurations are within the scope of the invention provided they create an adequate sealing or fastening mechanism.

Yet another sealing mechanism is shown in the illustrative embodiment depicted in FIGS. 6 and 7. This seal is created by the interface of the inner surface 113 of the side portion of container lid 101 and the outer surface of container lip 109. Container lip 109 also engages hook 134 to secure lid 101 onto container 102. The particular dimensions of hook 134 will depend at least in part on one or more factors such as container lip characteristics, container and lid materials and application of the container and lid.

Various sealing mechanisms have been depicted in FIGS. 1-7, such as those shown within channels 7 and 117. It is in the spirit and scope of the invention to mix and match these features to attain the most desirable container and lid characteristics for a particular application.

Figure 8:
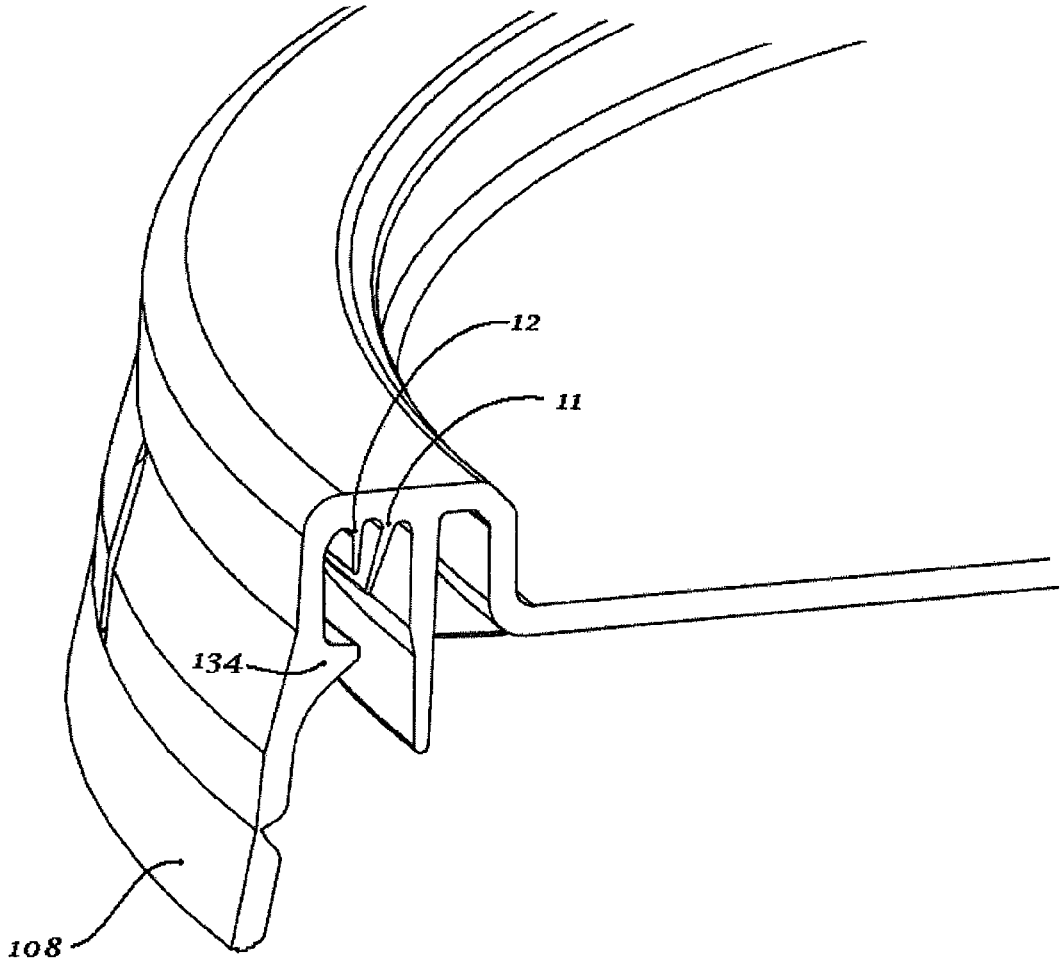
FIG. 8 depicts a lid according to a further illustrative embodiment of the invention.
Figure 9:
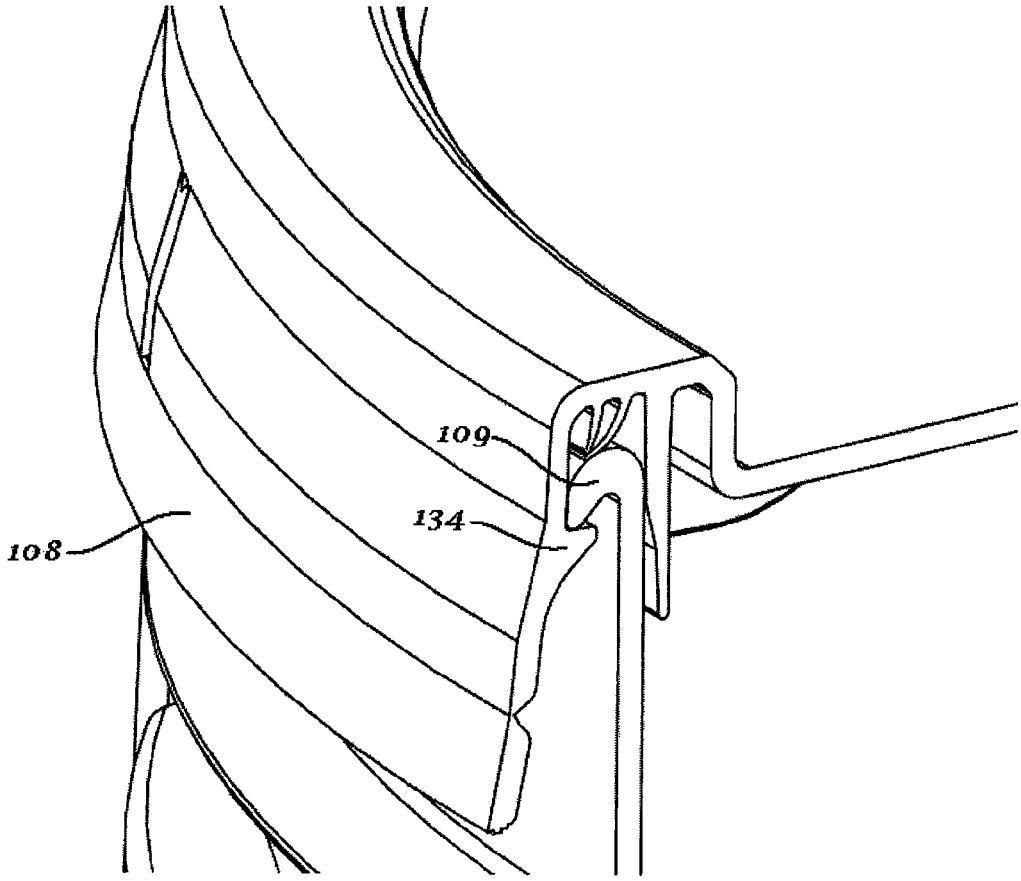
FIG. 9 shows an illustrative embodiment of the lid of FIG. 8 positioned on a container.

FIGS. 8 and 9 show a further illustrative embodiment of the invention that incorporates features shown in FIG. 3 and FIG. 6. This embodiment includes the flexible ribs 11 and 12 shown in FIGS. 3 and 4 but lacks u-shaped support member 126 diagramed in FIGS. 6 and 7. It also incorporates tear strip 108 and a latching interface between container lip 109 and rib 134 on the lid side portion as shown in FIGS. 6 and 7.

Figure 10:
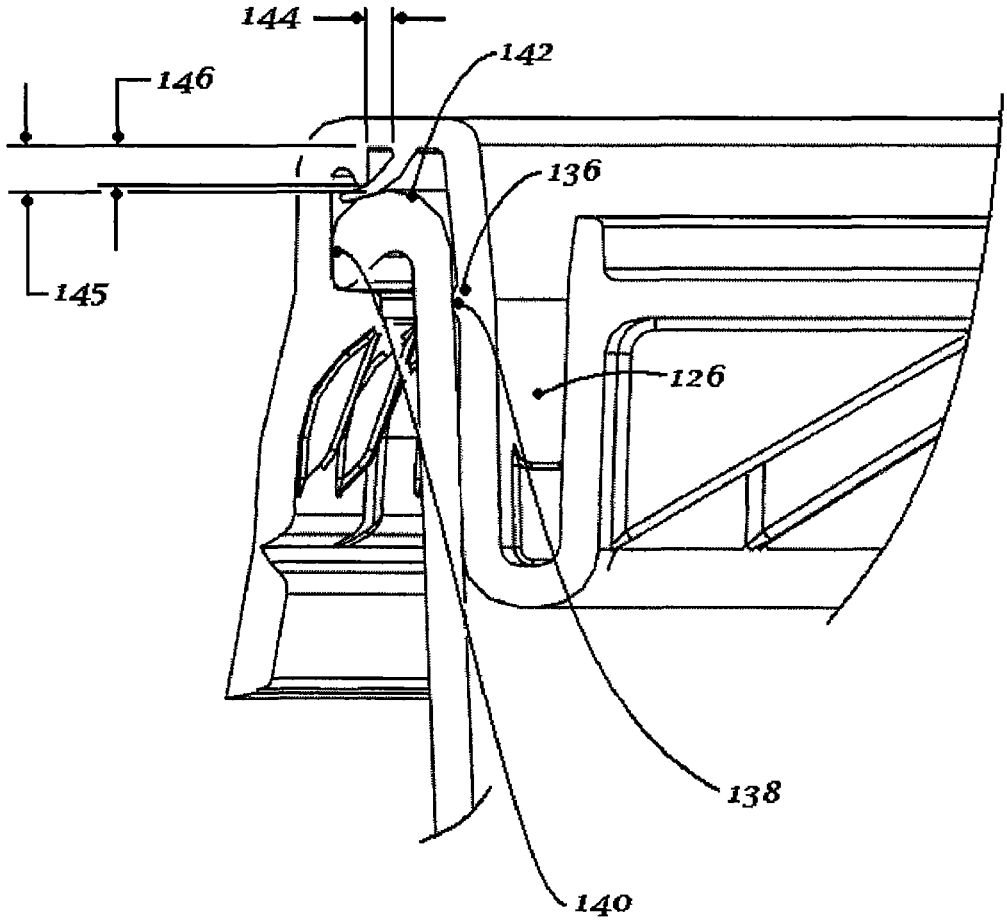
FIGS. 10 and 11 show various measurements for a lid and container combination such as depicted in FIGS. 6 and 7.

FIG. 10 shows sealing interfaces for a container and lid of the design shown in FIGS. 6 and 7. In an exemplary embodiment of the invention, the interference segment between the inner container wall and a bead 136 on u-shaped member 126, shown at 138, is in the range of about 0.015 inches and about 0.035 inches. The diameter of bead 136 can be chosen to attain an interference fit in this range. This illustrative interference segment length is applicable to a lid having an outer diameter in the range of about 11 inches to about 13 inches. A lid of that diameter is generally used on containers with volumes in the range of about 3.5 gallons to about 7.0 gallons. Any of the interference ranges provided herein should be scaled according to the container size, with greater interference lengths generally necessary for larger volume containers. All ranges provided are particularly applicable for container and lid sizes described above.

The interference fit is important for each sealing mechanism. In an exemplary embodiment of the invention, the inner diameter of the cover is sized to create an interference fit, also called a stretch fit, with the outer diameter of the container lip (shown at position 140 on FIG. 10) in the range of about 0.010 inches to about 0.030 inches.

The seal diameter, i.e. the distance from the tip of sealing rib 111 at one point on the container circumference to the tip of sealing rib 111 on the direct opposite side of the container (see location 160 on FIG. 11), as measured without the lid being on the container, must exceed the diameter of the container taken at the apex 142 of container lip 109, by a minimum of about 0.020 inches per side so that it will always deflect outward during cover installation.

Dimensions associated with ribs 111 and 112 are also important to achieve a desirable seal. The seal stop height 146, i.e, the distance from the bottom most point of rib 112 and the top of rib 112 is preferably in the range of about 0.10 inches to about 0.15 inches. Seal stop heights in this range will allow the cover to be pressed onto the container approximately 0.03 inches past the point where the hook (such as rib 134) engages with the container lip before the flap seal (rib 111) meets the seal stop (rib 112). Reference number 145 shows the face of from which rib 112 protrudes (the top of rib 112) to the apex 142 of container lip 109.

The gap distance 144, i.e. the distance between rib 111 and rib 112 along the face from which they protrude, is in the range of about 0.04 inches to about 0.08 inches in an exemplary embodiment of the invention. This distance along with the lengths of ribs 111, 112 will allow rib 111 to deflect under rib 112 so that rib 111 can form a secure interface with container lip 109. Rib 111 is preferably at an angle of between about 8° and about 12°, measured away from the vertical toward the lid center (see location 148 on FIG. 11). Flap seal height 150 as measured vertically (shown in FIG. 11) is preferably in the range of about 0.20 inches and about 0.30 inches.

Figure 11:
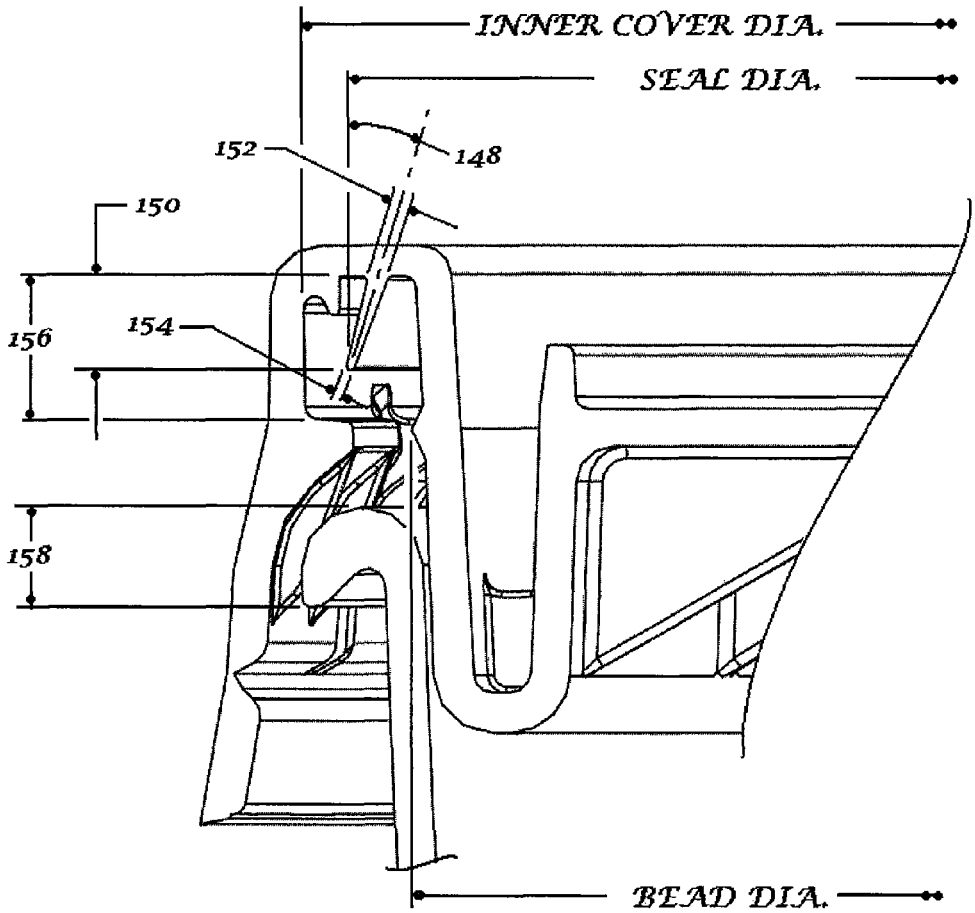

In an illustrative embodiment of the invention, the thickness of flap seal 111 ranges from a top thickness in the range of about 0.05 inches to about 0.07 inches; to a bottom thickness of about 0.020 inches to about 0.03 inches (see 152 and 154, respectively in FIG. 11). The composition of the flap material can affect ideal thickness, as both thickness and material composition affect stiffness, and hence sealing capacity. The proper thickness is that which maintains a suitable spring force of flap 111 against the container.

The distance 156, as shown on FIG. 11, from the face from which ribs 111, 112 protrude, to the top of rib 134 is preferably in the range of about 0.35 inches to about 0.45 inches.

The distance 158, from the apex of container lip 109 to the lowest point of the lip 109, is preferably in the range of about 0.20 inches to about 0.30 inches. The relative sizes of the seals stop (112) height and the flap seal (111) height are also important in order to form an adequate seal. In an exemplary embodiment of the invention, the seal stop height 146 is about 60% to about 80% of the flap seal height. In an illustrative embodiment of the invention it is in the range of about 0.01 inches to about 0.15 inches.

Figure 12:
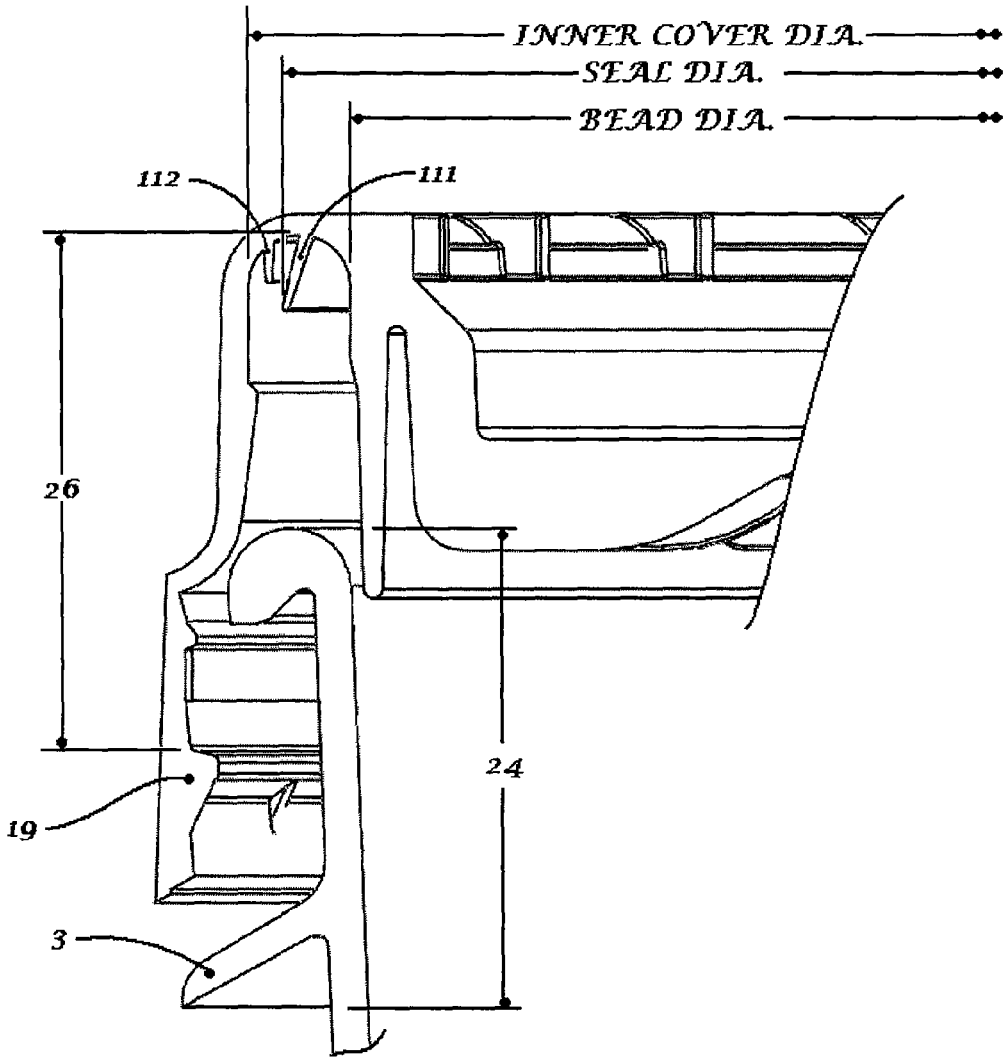
FIG. 12 depicts the container and lid of FIGS. 1-5 and shows various measurements.

FIG. 12 depicts the container and lid of FIGS. 1-5 and shows various measurements. For a container of that design having a volume of about 3.5 gallons to about 7 gallons with a lid having an outer diameter in the range of about 11 inches to about 13 inches, the various dimensions described above would also apply. In addition the height between the container lip apex and the lowest point of top most satellite ring 3 should be optimized. This height is indicated in FIG. 12 by reference number 24. In an illustrative embodiment of the invention, distance 24 is in the range of about 1.00 inches to about 1.40 inches.

Figure 5:
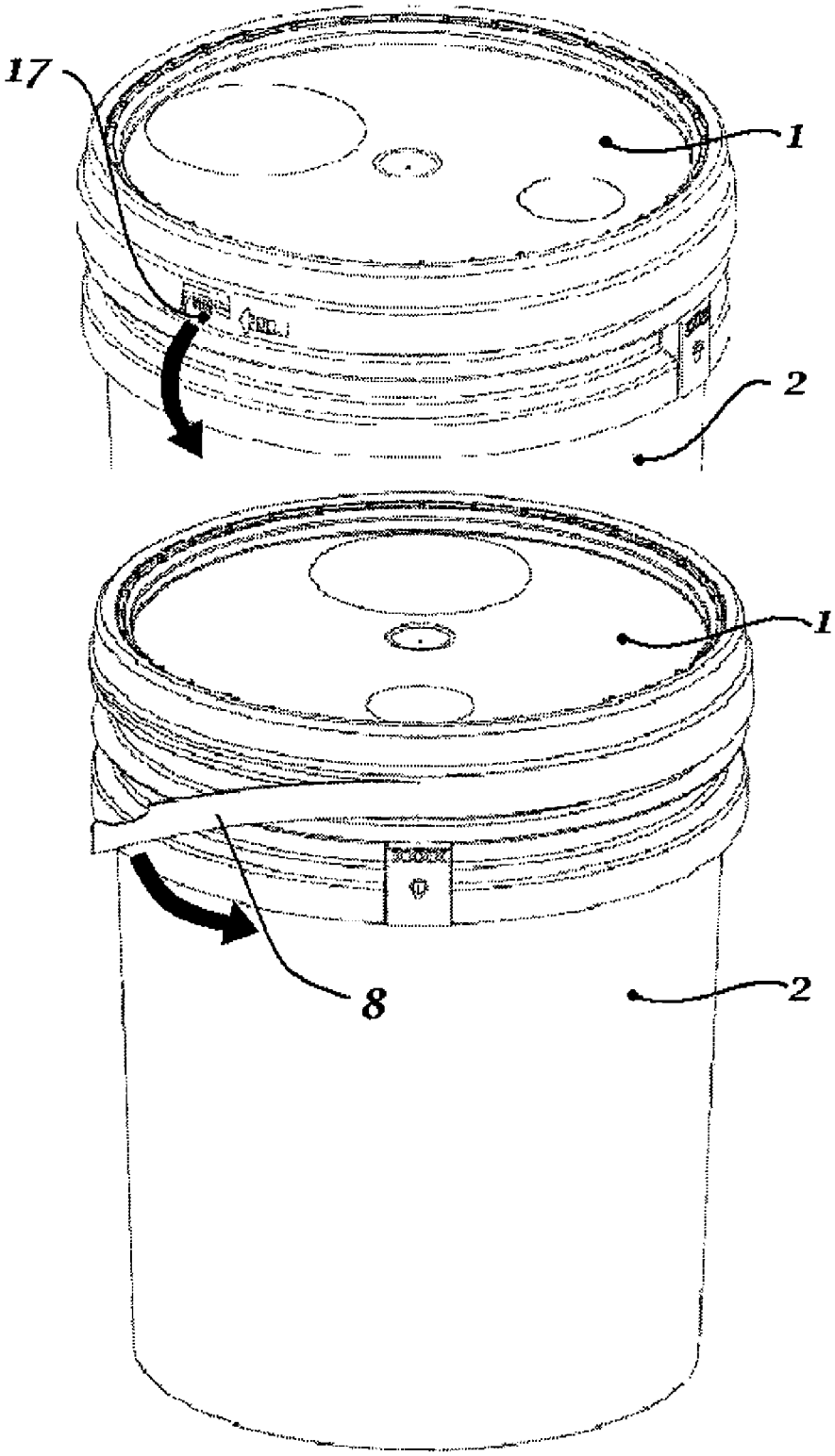
FIG. 5 depicts a lid and pail showing a tear strip a according to an illustrative embodiment of the invention.

Dimension 26 as shown on FIG. 12, is also significant if a design such as that depicted in FIGS. 1 and 5 is used wherein the lid engages a satellite ring in the pail. Distance 26, which extends from the lid face from which ribs 111, 112 protrude to the top of hook 19, should be sized for adequate seal compression.

Embodiments of the invention also include a container and lid assembly. The lid and the container can be of any embodiment described herein, provided that the lid is compatible with the container to create the desired seals. FIGS. 1-7 depict circular lids and pails, however, the scope of the invention includes other shaped pails, such as square and rectangular, for example.

Embodiments of the invention include containers and lids comprised of any material that can comprise the features that effectuate the seals incorporated therein. Generally, the lid features will need some flexibility to allow the ribs to deflect toward the pail to form a seal. The pail material does not necessarily need to be flexible to form the desired seals.

While the invention has been described by illustrative embodiments, additional advantages and modifications will occur to those skilled in the art. Therefore, the invention in its broader aspects is not limited to specific details shown and described herein. Modifications, for example, to the specific container and lid shapes and materials, may be made without departing from the spirit and scope of the invention. Accordingly, it is intended that the invention not be limited to the specific illustrative embodiments, but be interpreted within the full spirit and scope of the appended claims and their equivalents.

The invention claimed is:

1. A container lid comprising:

a top portion having a side portion extending downward with respect to the top portion along the perimeter of the top portion;

a cork seal mechanism having a substantially u-shaped circumferential protrusion extending downward from the lid top portion with the "u" opening facing upward such that when the lid is placed on the container, u-shaped circumferential protrusion is forced against an interior wall of the container;

the u-shaped circumferential protrusion having a bead positioned to create a single contact point between the u-shaped circumferential protrusion and the interior wall of the container;

a first flexible circumferential rib and a second circumferential rib, each extending from the underside of the top lid portion such that when the lid is placed on the container the first rib is deflected toward and contacts the second rib and the container, wherein the second rib remains substantially non-deflected and does not contact the container when the lid is secured on a container;

wherein the first and second ribs combine to create a single seal wherein the second rib limits the flexure of the first rib and creates a force against the first rib countering the force exerting by the container on the first rib, thereby increasing the strength of the seal between the first rib and the container;

wherein the first and second ribs are between the u-shaped cork seal mechanism and the lid side portion;

wherein when the lid is in place on the container, the side portion of the lid top portion stretches over a curved lip of a top edge of the container and contacts the lip, thereby creating an interference seal as a third seal and when the lid is positioned on a container having tapered sidewalls, a force exerted by the u-shaped circumferential protrusion on the interior wall of the container is directed outwardly, thereby strengthening the third seal;

wherein the seal diameter exceeds the diameter of the container at the apex of the lip of the container; and wherein the combination of seals forms a liquid tight seal without use of a gasket and without threaded engagement.

2. The container lid of claim 1 further comprising:

a tear strip disposed on the lid side portion; and one or more windows disposed above the tear strip extending down to the tear strip, such that when the tear strip is removed, the windows form slits in the lid side portion opening at the bottom of the lid side portion.

3. The container lid of claim 1 wherein the first rib deflects away from the center of the lid upon placement of the lid on the container.

4. The container lid of claim 1 wherein the second rib is shorter than the first rib.

5. The container lid of claim 1 wherein an interference segment between the inner container wall and the bead on the cork seal flap is in the range of about 0.015 inches and about 0.035 inches.

6. The container lid of claim 1 wherein the inner diameter of the side portion of the container lid is sized to create an interference fit with the outer diameter of the container lip.

7. The container lid of claim 6 wherein interference fit is in the range of about 0.010 inches to about 0.030 inches.

8. The container lid of claim 1 wherein the seal diameter exceeds the diameter of the container at the apex of the container lip by a minimum of about 0.020 inches per side.

9. The container lid of claim 1 wherein the seal stop height is in the range of about 0.10 inches to about 0.15 inches.

10. The container lid of claim 1 wherein the side portion has a continuous circumferential hook extending from an interior wall of the side portion of the lid top portion toward the center of the lid to engage the container lip.

11. The container lid of claim 10 wherein when the lid is pressed onto the container the container lip can extend approximately 0.03 inches past the point where the hook engages with the container lip before the first rib contacts the second rib.

12. The container lid of claim 1 wherein the gap distance is in the range of about 0.04 inches to about 0.08 inches.

13. The container lid of claim 1 wherein the first rib is preferably at an angle of between about 8° and about 12°, measured from the vertical toward the lid center.

14. The container lid of claim 1 wherein the first rib height as measured vertically is in the range of about 0.20 inches and about 0.30 inches.

15. The container lid of claim 1 wherein the thickness of the first rib ranges from a top thickness in the range of about 0.05 inches to about 0.07 inches to a bottom thickness in the range of about 0.020 inches to about 0.03 inches.

16. The container lid of claim 1 further comprising:

a hook extending from an interior wall of the side portion of the lid top portion toward the center of the lid;

wherein the distance from a face of the underside portion from which the first rib protrudes to the top of the hook is in the range of about 0.35 inches to about 0.45 inches.

17. The container lid of claim 1 wherein the distance from the apex of the container lip to the lowest point of the container lip is in the range of about 0.20 inches to about 0.30 inches.

18. The container lid of claim 1 wherein the second rib height is about 60% to about 80% of the first rib height as measured in a non-deflected position.

19. The container lid of claim 1 wherein the height between the container lip apex and the lowest point of a top most satellite ring on the container is in the range of about 1.00 inches to about 1.40 inches.

20. A container and lid system comprising:

a lid according to claim 1;

a container having sides with a circumferential top edge portion;

the container has a volume of about 3.5 gallons to about 7 gallons; and the lid has an outer diameter in the range of about 11 inches to about 13 inches;

wherein the container's top edge fits between the cork seal mechanism and the lid side portion and forms a seal between the outer surface of the container and the cork seal mechanism.

21. The container and lid assembly of claim 18 further comprising:

one or more protrusions disposed circumferentially around the container at a first height; and one or more protrusions disposed circumferentially around the container as a second height;

a tear strip disposed on the lid side portion; and one or more windows disposed above the tear strip extending down to the tear strip, such that when the tear strip is removed, the windows form slits in the lid side portion opening at the bottom of the lid side portion.

22. A method of sealing a container with a lid comprising:

providing a container and lid according to claim 20;

positioning the lid on the container so the container wall is between the cork seal mechanism and the lid side portion and the cork seal mechanism is forced against the inner wall of the container; and forcing the lid further onto the container so the container lip contacts the first rib and deflects it toward the second rib such that it makes contact with the second rib; and wherein the second rib remains substantially non-deflected when the lid is secured on the container; and wherein the seal diameter exceeds the diameter of the container at the apex of the container lip.

23. The method of claim 22, wherein the lid has a hook, the method comprising:

pressing the lid onto the container causing the container lip to extend approximately 0.03 inches past the point where the hook engages with the container lip before the first rib contacts the second rib.

24. The container lid of claim 1 wherein:

the container lid has an outer diameter in the range of about 11 inches to about 13 inches; and the container lid is configured to create a water-tight seal when secured on a container having a volume in the range of about 3.5 gallons to about 7 gallons.

* * * * *